US005876563A

United States Patent [19]

Greenwood

[11] Patent Number: 5,876,563

[45] Date of Patent: Mar. 2, 1999

[54] MANUFACTURE OF PAPER

[75] Inventor: Graham Greenwood, Lancashire, United Kingdom

[73] Assignee: Allied Colloids Limited, West Yorkshire, England

[21] Appl. No.: 727,229

[22] Filed: Oct. 8, 1996

Related U.S. Application Data

[63] Continuation-in-part of Ser. No. 457,438, Jun. 1, 1995, abandoned.

[30] Foreign Application Priority Data

Jun. 1, 1994 [GB] United Kingdom ..... 9410965
Oct. 9, 1995 [GB] United Kingdom ..... 9520633

[51] Int. Cl.[6] ..... D21H 17/28

[52] U.S. Cl. ..... 162/175; 162/168.1; 162/168.2; 162/168.3; 162/181.6; 162/181.8; 162/183

[58] Field of Search ..... 162/175, 168.1, 162/168.2, 168.3, 183, 181.6, 181.8, 158, 164.1, 164.6

[56] References Cited

U.S. PATENT DOCUMENTS

| | | | |
|---|---|---|---|
| 2,729,561 | 1/1956 | Chung | 162/168.1 |
| 3,468,706 | 9/1969 | Speakman | 162/175 |
| 3,930,877 | 1/1976 | Aitken | 162/175 |
| 4,347,100 | 8/1982 | Brucato | 162/175 |
| 4,388,150 | 6/1983 | Sunden et al. | 162/175 |
| 4,609,432 | 9/1986 | Brucato | 162/175 |
| 4,913,775 | 4/1990 | Langley et al. | 162/168.3 |
| 5,126,014 | 6/1992 | Marrone | 162/175 |

FOREIGN PATENT DOCUMENTS

| | | |
|---|---|---|
| 787294 | 6/1968 | Canada . |
| 1232713 | 2/1988 | Canada . |
| 0235893 | 1/1987 | European Pat. Off. . |
| 0499448 | 2/1992 | European Pat. Off. . |
| 499448 | 8/1992 | European Pat. Off. . |
| 2223038 | 3/1990 | United Kingdom . |
| WO 9533096 | 12/1995 | WIPO . |

OTHER PUBLICATIONS

Okomori et al., Basic Properties of Handsheet containing starch pulp, 1994, pp. 237–241.

Moore, Charge Relationshps of dual polymer retention aids, 1976, pp. 120–122.

Springer et al., The Influence of starch on drainage . . . 1984, pp. 104–108.

Starch Application, Review and a method for further consideration.

*Primary Examiner*—Peter Chin

*Attorney, Agent, or Firm*—Sughrue, Mion, Zinn, Macpeak & Seas, PLLC

[57] ABSTRACT

Paper strengthened by starch, typically in amounts of 3 to 15% dry weight, is made by flocculating a cellulosic suspension using a polymeric retention aid which can be dissolved cationic starch but is preferably a synthetic polymer having IV above 4 dl/g, optionally shearing the resultant flocculated suspension and reflocculating it by adding bentonite or other microparticulate anionic material, draining the flocculated or reflocculated suspension and drying the resultant wet sheet, wherein insoluble particles of starch are added to the suspension as a slurry of substantially freely dispersed particles in part or all of the aqueous solution of the polymeric retention aid or in part or all of the aqueous suspension of microparticulate anionic material. In the process improved retention of starch may be obtained when the aqueous solution of the polymeric retention aid also contains a cationic coagulant selected from inorganic cationic coagulants and cationic polymeric materials having intrinsic viscosity 3 dl/g or below and charge density at least 4 meq/g.

9 Claims, No Drawings

MANUFACTURE OF PAPER

RELATED APPLICATIONS

This application is a continuation-in-part of application Ser. No. 457,438 filed 1 Jun., 1995 now abandoned by one of the present inventors.

BACKGROUND OF THE INVENTION

This invention relates to the production of paper which is strengthened by starch.

It is standard practice to make paper on a paper-making machine by providing a cellulosic thin stock suspension, flocculating the suspension by adding a solution of polymeric retention aid and thereby forming a flocculated suspension, draining the flocculated suspension through a moving screen to form a wet sheet, and carrying the sheet through a heated drying zone and thereby forming a dry sheet. The retention aid can be dissolved cationic starch but is often a synthetic polymeric material. Although the use of polymer of rather low molecular weight can give some improvement in retention, the polymer is preferably of high or very high molecular weight, generally having intrinsic viscosity above 4 dl/g.

A common alternative to this process involves shearing the flocculated suspension so as to degrade the flocs and then adding an aqueous suspension of micro-particulate anionic material and thereby reflocculating the suspension, and then draining the reflocculated suspension through the screen. Such processes using cationic starch and colloidal silica are described in U.S. Pat. No. 4,388,150 and processes using cationic synthetic polymer and bentonite are described in EP-A-235,893. Processes in which size is added after the flocculation with the cationic polymer are described in EP-A-499,448. Processes using other polymers and suspensions suitable for these are described in WO95/02088.

The cellulosic thin stock is often formed in part from recycled paper which may include soluble starch (cationic or anionic or non-ionic) and so the thin stock, and the final sheet, often includes soluble starch. For instance the dry sheet may contain as much as 1% starch derived from recycled paper. It is, however, often desired to add starch to the thin stock.

Thus, water soluble cationic starch may be added as part or all of the solution of polymeric retention aid (see for instance U.S. Pat. No. 4,388,150). The amount required for this purpose is usually not more than about 0.3% (dry weight starch based on the dry weight of paper).

It is often desired to add starch in order to strengthen the paper. For instance it is particularly desirable to include significant amounts of starch in fluting medium and liner board. These materials are usually substantially unfilled and increasing their strength makes them more suitable for use as packaging materials. It is also desirable to include significant amounts of starch in filled sheets as the inclusion of significant amounts of filler would otherwise tend to reduce the strength of the sheet.

In order to maximise strength, it is desirable to include starch in amounts of as much as 5 or 10% or even higher, but attempting to achieve this tends to make the process less efficient as regards energy consumption and/or rate of production, or can incur the risk of unacceptable increase in the chemical oxygen demand of the effluent from the process, because of increased starch in the effluent.

Various grades of starch are conveniently commercially available and include grades which are usually insoluble in the cellulosic suspension. They can be used either unmodified or chemically modified. Generally the starch is pre-solubilised at high temperature to render the starch soluble in the cellulosic suspension.

In this specification when we say a starch is insoluble we mean that it is insoluble in the cellulosic suspension and remains substantially undissolved in the cellulosic suspension. When we say a starch is soluble we mean it is soluble in the cellulosic suspension.

Soluble cationic starch is reasonably substantive to the cellulosic fibres in amounts up to about 1 to 1.5% by weight of the starch, based on the dry weight of the paper. If the amount of cationic starch in the suspension is increased significantly above this, there may be little or no increase in the amount of starch which is retained in the paper and, instead, there is merely an increase in the amount of soluble cationic starch which is in the white water which drains through the screen. This is undesirable since it has to be removed before discharge as effluent, because of the high chemical oxygen demand that it may create in the effluent from the mill.

The soluble cationic starch can be made by chemical modification of starch or merely by cooking raw starch and adding a low molecular weight cationic polymer before, during or after the cooking. Suitable low molecular weight cationic polymers have intrinsic viscosity below 1 dl/g. Examples of such systems are in CA 787,294 and U.S Pat. No. 3,930,877.

In practice, when starch is being used as a strengthening aid it is usually necessary also to include a polymeric retention aid, and there have been various publications about adding combinations of materials. For instance in Tappi June 1976, 59, 6, pages 120 to 122 the performance of various dual polymer systems is examined, including the performance of a blend of soluble cationic starch and hydrolysed polyacrylamide. In CA 1,232,713 up to 1.5% soluble cationic starch is applied in combination with polyethylene oxide or cationic, non-ionic or anionic polyacrylamide retention aid having molecular weight above 1 million.

In Tappi Journal, February 1984, pages 104 to 108, the effects of addition of various starches are examined. It is indicated that starch is generally included in the paper at the size press. It is stated that cationic starch at 1% by weight improves drainage and retention but gives adverse effects at levels above this. It is stated that anionic starches can have either a positive or negative effect on drainage depending on the furnish.

In normal commercial practice it is found that if the amount of cationic starch is increased above about 1 or 1.5% there is increased risk that the cationic starch will interfere with the effectiveness of the polymeric retention aid. As a result retention and drainage may deteriorate with the result that the machine has to operate more slowly or product quality deteriorates.

When it is desired to include a greater amount of starch than 1 to 1.5%, the usual technique involves applying an unmodified starch solution on a size press at the end of the paper-making machine, i.e., after partial or complete drying of the sheet. The application of a solution of starch at this point can result in high pick-up (for instance up to 7 or 10% is common). However it can result in the starch being concentrated more on the surface than in the centre of the sheet and it has the particular disadvantage that it necessitates redrying of the sheet, thus wasting heat energy and/or slowing down the process. It would therefore be desirable to be able to achieve these or higher levels of starch without providing unacceptable levels of soluble starch in the white water and without having to redry the sheet.

Another known method for providing significant loadings of starch in the paper involves applying a spray or a foam containing undissolved starch particles on to the wet sheet before it is carried through the driers, followed by cooking the starch during drying. This process also has the disadvantage of tending to produce a higher concentration of starch on the surface than in the centre of the sheet. However its particular disadvantage is that it is very difficult to achieve uniform application of the starch by spraying or foam application for prolonged periods because of the tendency of the starch composition to cause blockages in the spray or foam applicators.

Attempts to include cold-water insoluble particulate starch in the suspension before drainage have been proposed in the literature but have not achieved success. For instance Fowler reviewed the general techniques of adding starch in Paper 1978 pages 74 and 93. He discussed the techniques mentioned above and also stated that if raw uncooked starch is added to the suspension followed by the addition of retention aid only minimal retention of starch can be achieved. He proposed that better retention is achieved if the starch is slurried with bentonite and added to the suspension prior to the retention aid, and he also proposed that retention can be increased further by including in the slurry a polymer having a charge opposite to the charge of the retention aid.

In U.S. Pat. No. 4,347,100 Brucato describes that mechanical and thermomechanical pulping processes can be improved by adding an anionic surfactant or an anionic polymer during the pulping process. He states that the addition of a cationic polymer causes reaction with the anionic polymer and the formation of a gum-like precipitate which contributes to strength, and he recommends the addition of cationic polymer in a stoichiometric amount based on the anionic polymer. He describes a titration technique for obtaining the desired stoichiometric amount. He also proposes that optimum strength can be achieved by including ungelatinised starch which is gelatinised during subsequent heat drying.

He states that the reaction of the cationic and anionic polymers to produce a gum-like precipitate carries the starch particles and retains the starch in the wood fibres. He says that the furnish is then supplied to the paper-making machine where it is formed into a sheet and heat dried. This suggests that the starch is being added to the pulp or to the thick stock. In all the examples the pulp had a consistency of 2.3% but Brucato suggests higher consistencies are desirable. The strengths are all measured on hand sheets. He gives no information about whether the process could be conducted on a paper making machine, nor how this could be done, nor the extent of retention of starch that can be achieved.

Brucato describes in U.S. Pat. No. 4,609,432 another method of obtaining strengthened paper, this time using two different cellulosic suspensions. 90 to 98% of the fibre weight is provided by a first cellulosic suspension, usually of refined fibres, and 2 to 10% of the fibre weight is provided by adding to this first suspension a second cellulosic suspension which contains a heat-sensitive bonding agent (such as uncooked starch) for bonding the fibres and a polymer for adhering the bonding agent to the fibres of the second suspension. For instance the second suspension can contain the second cellulosic fibres together with 20 to 200% uncooked dry starch and 0.01 to 0.1% cationic polymer. The cationic polymer is said to coat the starch particles and adhere them to the fibres of the second suspension. A typical process uses a first suspension containing 95% of the total fibres and a second suspension containing 5% of the fibres, 0.012% polyethylene imine and 20% starch. A hand sheet was formed from this and was then dried and it appears that the starch is activated during the drying. Again there is no indication about how to conduct the process on a machine nor about retention.

Brucato quotes the same list of cationic polymers in both patents, namely polyethylene imines (which are preferred in U.S. Pat. No. 4,609,432), polyamide polyamine resins, urea formaldehyde resins, melamine formaldehyde resins and polyacrylamides. It seems that Brucato wants to use low molecular weight polymers only since all the classes of polymers he mentions except for the polyacrylamides inevitably have very low molecular weight and the polyacrylamide he exemplifies is Separan CP7, a trade mark of Dow Chemical Co., and we believe that this material also has a relatively low molecular weight, of about 1 million.

There is no suggestion in either of the Brucato patents that any additional retention aid should be used. For instance the highest dosage which is exemplified is around 0.002% based on total fibre weight.

The Brucato methods therefore do not result in the production of a flocculated or reflocculated suspension of the type that is attainable by the use of high molecular weight synthetic polymers or cationic starch optionally followed by anionic microparticulate material.

It is desirable to strengthen substantially unfilled sheets of paper (including paper board) that is to be used as packaging, but there is also a particular need to include starch as a strengthening aid in sheets which are highly filled, since the use of a large amount of filler tends to weaken the sheet. The filler can be preflocculated before addition to the cellulosic suspension. Although this has some advantages, it can cause particular weakening of the sheet. It is therefore known to include water-soluble starch in the pre-flocculated filler composition, but this causes difficulties in handling the flocculated suspension.

In GB 2,223,038 filler is included in a cellulosic suspension by adding a slurry of filler, insoluble starch particles and flocculating agent. The exemplified flocculating agents are anionic or non-ionic, although cationic flocculating agents are mentioned. Those mentioned have low or moderate molecular weight. There is no suggestion to include a high molecular weight cationic flocculating agent. Suspending agents such as a gum, a synthetic organic polymer, or a swelling clay (eg, bentonite), can be included and preferably the suspending agent is chosen so as to reduce the net charge in the composition close to zero. The aim is to flocculate the filler-containing suspension. The resulting flocculated suspension will contain the starch particles trapped in the filler flocs and is added to the cellulosic suspension which is then drained and heated, with consequential cooking of the starch.

Accordingly, none of these detailed methods provide any practical solution to the problem of providing a convenient technique which uses readily available starch and which does not result in undesirable contamination of effluent and which is capable of giving very high pick-up of starch in the paper and which does not involve the problems of size press application or spray or foam application on to the wet sheet.

So far as we are aware, the proposals of Fowler, Brucato and in GB 2,223,038 have not resulted in satisfactory processes for producing sheets containing a large amount of starch as a result of incorporating all the starch in the suspension before drainage. Accordingly, the problem remains that if large amounts of starch are to be incorporated then they have to be added to the wet sheet by spraying or foam or at the size press, and there remains an urgent need to find a way of incorporating starch in the thin stock so as to allow efficient and environmentally acceptable production of paper having a high starch content.

Support for our belief that such a process is not known arises from the fact that in Nordic Pulp and Paper Research Journal Number 4 1994 pages 237 to 241 it is stated that since starch has granular form with diameter of about 1 to 40 μm the retention of the starch granules is very low when added directly to paper stock without dissolution or swelling in water. According to the proposals in this article it is possible to include high amounts of starch in laboratory handsheets by including in the cellulosic suspension starch having a particular flake form and which has been made by precipitation in mineral salts and processing the precipitate. It is commercially undesirable to have to undergo this particular process and it would be much more convenient to be able to obtain high starch levels in paper made on a conventional paper-making machine using conventional granular starches and without incurring significant effluent problems due to excessive drainage of starch through the screen.

SUMMARY OF THE INVENTION

In a first aspect of the invention, we make paper on a papermaking machine by a process comprising providing a cellulosic thinstock suspension flocculating the suspension by adding an aqueous solution of polymeric retention aid selected from dissolved cationic starch and synthetic polymer having IV at least 4 dl/g and thereby forming a flocculated suspension, optionally shearing the flocculated suspension and reflocculating the sheared suspension by adding an aqueous suspension of microparticulate anionic material and thereby forming a reflocculated suspension, draining the flocculated or reflocculated suspension through a moving screen to form a wet sheet, and carrying the sheet through a heated drying zone and thereby forming a dry sheet, wherein insoluble particles of starch are added to the cellulosic suspension as a slurry of substantially freely dispersed particles in part or all of the aqueous solution of the polymeric retention aid or in part or all of the aqueous suspension of microparticulate anionic material and the insoluble particles of starch are heated during the drying and release soluble starch into the sheet in the presence of moisture.

The first aspect of the invention can be conducted with or without the shearing and reflocculation with micro- particulate anionic material. Best results are obtained in the invention when the process involves the described shearing and reflocculation stages.

In order to promote good retention it is important that the particles of the starch should be able to interact with the surfaces of the cellulosic fibres and, if present, the anionic microparticulate material. It is therefore desirable for the starch particles to be added as a slurry of substantially independent particles so that the particles can interact with the fibres or microparticulate anionic material substantially independent of each other.

Using the method of this aspect of the invention we have been able to increase strength of the paper in a convenient and efficient production process and without creating unacceptable effluent problems. However, we have found that in some cases there is room for improvement.

We have found that with the use of certain starches we observe reduced efficiency of the retention aid system so that larger amounts of polymeric retention aid and sometimes of anionic microparticulate material are required to achieve the same retention effect. This is observed in particular when the retention aid is a cationic material. It is also observed in particular where the white water from the process is recirculated into the stock.

We have therefore additionally developed a preferred papermaking process which allows incorporation of high levels of even "difficult" starches evenly distributed in the final paper and which gives highly efficient use of the retention system.

In this preferred system, the starch particles are included in part or all of the aqueous solution of the polymeric retention aid, and this solution also contains a cationic coagulant selected from inorganic cationic coagulants and cationic polymeric materials having intrinsic viscosity 3 dl/g or below and charge density at least 4 meq/g.

We find that this preferred form of the invention allows incorporation of high levels of starch uniformly distributed in a paper sheet. It also allows this incorporation without compromising the efficiency of the retention system used. In particular the introduction of the cationic coagulant leads to improved overall retention in the papermaking process at a given level of starch, polymeric retention aid and microparticulate material (if used). It also leads to improved retention of insoluble starch particles and thus allows the incorporation of increased levels of starch. It also allows incorporation of higher starch levels without the need to increase retention aid levels. As a result paper of greater strength can be produced.

Without wishing to be limited by theory, we believe that the benefit of this preferred aspect of the invention lies at least in part in the discovery that certain cold water insoluble starches, although the particles of starch themselves do not dissolve to any substantial extent, tend to release anionic charge into the aqueous slurry, possibly by release of soluble anionic materials, creating a cationic demand in the aqueous slurry of insoluble starch particles. This can interfere with the efficient action of the polymeric retention aid, in particular if it is itself cationic.

Without wishing to be limited by theory, we believe that the effectiveness of the preferred process of the invention arises due to the association of the high charge density cationic coagulant with the anionic charge released into the aqueous slurry by the raw starch. This satisfies the cationic demand of the slurry and allows efficient action of the polymeric retention aid without interference.

A preferred second aspect of the invention is a process for making paper on a papermaking machine which comprises providing a cellulosic thinstock suspension, flocculating the suspension by adding an aqueous solution of polymeric retention aid selected from dissolved cationic starch and synthetic polymer having intrinsic viscosity at least 4 dl/g and thereby forming a flocculated suspension, shearing the flocculated suspension and reflocculating the sheared suspension by adding an aqueous suspension of micro-particulate anionic material and thereby forming a reflocculated suspension, draining the reflocculated suspension through a moving screen to form a wet sheet and carrying the sheet through a heated drying zone and thereby forming a dry sheet, wherein insoluble particles of starch are added to the cellulosic suspension as a slurry in part or all of the solution of polymeric retention aid, and the insoluble starch particles are heated during the drying to release soluble starch into the sheet in the presence of moisture.

Also in this aspect of the invention it is preferred that the aqueous solution of the polymeric retention aid also contains a cationic coagulant selected from inorganic cationic coagulants and cationic polymeric materials having intrinsic viscosity 3 dl/g or below and charge density at least 4 meq/g.

In these preferred processes good retention of fibres, starch particles (and filler if present) is achieved by the reflocculation stage. The application of shear to the flocculated suspension containing the cellulosic fibres and the starch particles results in degradation of flocs in the flocculated suspension and redispersion of the previously flocculated material. As a result, any flocs of starch particles, or of fibres free of starch particles, tend to be broken up by the shearing. The consequence of this is that a very uniform distribution of the individual starch particles is achieved in the reflocculated suspension, and thus in the drained sheet. As a result of this uniformity, the gelatinisation during the drying can be conducted more efficiently and the distribution of the starch within the sheet both before gelatinisation and after gelatinisation can be more uniform than if the process is conducted without the shearing and reflocculation.

Although it is preferred that the slurry of starch is added in a form wherein the starch particles are substantially freely dispersed in it, some flocculation of the starch particles by the retention aid, or some coagulation of the starch particles by the cationic coagulant, can be acceptable when the resultant flocculated cellulosic suspension is sheared then reflocculated since this shearing will break up any initial flocs in the initial slurry.

The slurry may include some filler or fibres. Generally however it is preferred that the slurry consists essentially only of the polymeric retention aid, the insoluble starch particles and, if used, the cationic coagulant.

The paper that is produced can be filled, and an advantage of the invention is that papers having good strength can be obtained even when they contain high amounts of filler, for instance more than 20% by weight or more than 40% by weight and even up to 60% by weight based on the dry weight of the paper. Conventional fillers such as calcium carbonate or sulphate or talc or kaolin or other clays can be used.

Another feature of the invention is that it permits the production of unfilled paper, that is to say paper to which little or no deliberate addition of filler is made. This substantially unfilled paper generally has a filler content of not more than 15%, and usually not more than 10% by weight of the dry sheet. Usually any filler which is included originates from recycled paper which is used in forming the cellulosic suspension but if desired small amounts, for instance up to 5% or perhaps 10% by weight based on the dry weight of the suspension can be deliberately added to the suspension. The invention is therefore of particular value for the manufacture of fluting medium or liner board.

Accordingly, in a third aspect of the invention we make substantially unfilled fluting medium or liner board on a papermaking machine by a process comprising providing a substantially unfilled cellulosic thinstock suspension, adding an aqueous solution of polymeric retention aid selected from dissolved cationic starch and synthetic polymer having intrinsic viscosity at least 4 dl/g, draining the suspension through a moving screen to form a wet sheet, and carrying the sheet through a heated drying zone and thereby forming a dry sheet, and wherein insoluble particles of starch are added to the suspension as a slurry, preferably of substantially freely dispersed particles, in part or all of the aqueous solution of the retention aid, and wherein the insoluble particles of starch are heated during the drying and release soluble starch into the sheet into the presence of moisture.

In this process it is preferred that the aqueous solution of the polymeric retention aid also contains a cationic coagulant selected from inorganic cationic coagulants and cationic polymeric materials having intrinsic viscosity 3 dl/g or below and charge density at least 4 meq/g.

In this aspect of the invention, the process can be performed by draining the flocculated suspension which results from the addition of the polymeric retention aid or by shearing that flocculated suspension and reflocculating it by the addition of an aqueous suspension of micro-particulate anionic material, and then draining the resultant reflocculated suspension.

In this aspect of the invention the particles of insoluble starch are preferably substantially freely dispersed in the slurry. However, some flocculation or coagulation of the starch is acceptable, in particular where the flocculated suspension is subjected to shear and reflocculation.

A unique characteristic of the invention is that we can achieve a high starch content in the dry sheet as a consequence of the inclusion of the undissolved starch in the cellulosic suspension without causing pollution problems and without comprising retention performance. Thus we can easily obtain a content of at least 2% or 3% and typically 5% and even up to 10 or 15% by weight starch in the dry sheet.

According to a fourth aspect of the invention we provide a process of making paper which comprises providing a cellulosic suspension, flocculating the suspension by adding an aqueous solution of polymeric retention aid selected from dissolved cationic starch and synthetic polymer having intrinsic viscosity at least 4 dl/g and thereby forming a flocculated suspension, optionally shearing the flocculated suspension and reflocculating the sheared suspension by adding an aqueous suspension of microparticulate anionic material and thereby forming a reflocculated suspension, draining the flocculated or reflocculated suspension through a screen to form a wet sheet, and heating and drying the wet sheet and thereby forming a dry sheet, wherein insoluble particles of starch are added to the cellulosic suspension as a slurry in part or all of the aqueous solution of the retention aid, and a cationic coagulant selected from inorganic cationic coagulants and cationic polymeric material having intrinsic viscosity 3 dl/g or below and charge density at least 4 meq/g, is added to the suspension in any or all of the following ways:

(a) in part or all of the aqueous solution of the retention aid, (b) separate from but simultaneously with the aqueous solution of polymeric retention aid, (c) before the addition of the aqueous solution of polymeric retention aid, (d) after the addition of polymeric retention aid, and wherein the insoluble particles of starch are heated during the drying and release soluble starch into the sheet in the presence of moisture.

In this aspect of the invention the cationic coagulant is added to the cellulosic suspension at any point which enables it to counteract the cationic demand produced by the cold-water insoluble starch particles. Thus it can be added before, after or simultaneously with the polymeric retention aid. If it is added simultaneously with the retention aid this can be as a component of the aqueous solution of polymeric retention aid.

In a single process it is possible for the cationic coagulant to be added in one or more of the manners (a) to (d) in two or more portions. Preferably however the cationic coagulant is added in a single portion at one position only.

In this aspect of the invention, the process can be performed by draining the flocculated suspension which results from the addition of the polymeric retention aid or by shearing that flocculated suspension and reflocculating it by the addition of an aqueous suspension of micro-particulate anionic material, and then draining the resultant reflocculated suspension.

In a fifth aspect of the invention we provide a process of making paper comprising providing a cellulosic thinstock suspension, flocculating the suspension by adding an aqueous solution of polymeric retention aid selected from dissolved cationic starch and synthetic polymer having IV at least 4 dl/g and thereby forming a flocculated suspension, shearing the flocculated suspension and reflocculating the sheared suspension by adding an aqueous suspension of microparticulate anionic material and thereby forming a reflocculated suspension, draining the reflocculated suspension through a screen to form a wet sheet, and heating and drying the wet sheet and thereby forming a dry sheet, wherein insoluble particles of starch are added to the cellulosic suspension as a slurry in part or all of the aqueous suspension of microparticulate anionic material, and a cationic coagulant, selected from inorganic cationic coagulants and cationic polymeric materials having intrinsic viscosity 3 dl/g or below and charge density at least 4 meq/g, is added to the cellulosic suspension in a manner selected from any or all of the following:

(a) as a component of part or all of the aqueous solution of the polymeric retention aid (b) separate from but simultaneously with the solution of polymeric retention aid, (c) before addition to the cellulosic suspension of the aqueous solution of polymeric retention aid, (d) after addition to the cellulosic suspension of the solution of polymeric retention aid but before addition to the sheared suspension of the aqueous suspension of microparticulate anionic material, and the insoluble particles of starch are heated during the drying and release soluble starch into the sheet in the presence of moisture.

In this aspect of the invention the starch is added together with the anionic particulate material and the cationic coagulant is added at any point which allows it to counteract the cationic demand provided by the starch slurry.

Thus the cationic coagulant can be added before, simultaneously with or after addition of the retention aid. Portions of cationic coagulant may be added at one or more of these stages in a single process.

According to a sixth aspect of the invention, we make paper on a paper-making machine by a process comprising providing a cellulosic suspension, flocculating the suspension by adding an aqueous solution of polymeric retention aid selected from dissolved cationic starch and synthetic polymer having intrinsic viscosity at least 4dl/g and thereby forming a flocculated suspension, optionally shearing the flocculated suspension and reflocculating the sheared suspension by adding an aqueous suspension of micro-particulate anionic material and thereby forming a reflocculated suspension, draining the flocculated or reflocculated suspension through a moving screen to form a wet sheet, and carrying the sheet through a heated drying zone and thereby forming a dry sheet, wherein we include in the cellulosic suspension insoluble starch particles in an amount of above 3% by weight based on the dry weight of the suspension, and we retain insoluble starch particles in the wet sheet in an amount of at least 3% based on the dry weight of the sheet and heat the insoluble particles during the drying and thereby release soluble starch into the sheet in the presence of moisture.

In this process, preferably the aqueous solution of the polymeric retention aid also contains a cationic coagulant selected from inorganic cationic coagulants and cationic polymeric materials having intrinsic viscosity 3 dl/g or below and charge density at least 4 meq/g.

The preferred way of performing this sixth aspect of the invention is by including the starch as a slurry in part or all of the aqueous solution of polymeric retention aid or in part or all of the aqueous suspension of microparticulate anionic material. However other ways of including it can be used. For instance the particles may be sprayed or otherwise coated with a solution of the retention aid and added to the cellulosic suspension before or after adding the remainder of the retention aid.

In this and other processes of the invention we preferably achieve high retention of the starch particles added (eg, above 80% or 90% or more), and any starch particles that do drain into the white water can be tolerated as they can be insoluble in the white water and so can be recycled and trapped on a subsequent pass through the machine. Alternatively they can be removed by filtration before discharge.

In all aspects of the invention, when the cationic coagulant is used, it is included in the cellulosic suspension in an amount sufficient to satisfy the cationic demand of the starch-containing slurry. That is, it is added in an amount sufficient to prevent anionic charge released into the aqueous slurry by the cold water insoluble starch interacting with the retention aid and reducing the efficiency of its action to an unacceptable extent. For instance, the cationic coagulant is added in an amount sufficient to show an improvement in retention at a specified level of starch addition and retention aid or sufficient to allow increased starch levels to be included in the suspension whilst maintaining retention performance and retention aid level.

DESCRIPTION OF THE PREFERRED EMBODIMENTS

The ratio of total cationic coagulant added to the cellulosic suspension to total insoluble starch particles added to the cellulosic suspension is usually in the range 1:2,000 to 1:5, preferably 1:1,000 to 1:10, often 1:200 to 1:20. The level of added cationic coagulant should be selected with regard to the type of starch and its tendency to release anionic charge into the suspension and create cationic demand. Suitable ratios of starch to cationic coagulant can be established by appropriate experimentation for any particular combination of cationic coagulant and insoluble starch.

Preferably the starch and cationic coagulant are both added as components of the aqueous solution of polymeric retention aid. In this case, the preferred ratios of starch to cationic coagulant in the aqueous solution of polymeric retention aid are those given above.

Frequently the starch is provided initially as a slurry of 10 to 40%, often around 20%, by weight starch in water and this slurry is used in the amounts required to give the chosen dosage of starch. Starch is generally added in an amount of at least 1.5%, often at least 2% or 3% or even 5%, 10% or more, based on solids content of the cellulosic suspension.

The polymeric retention aid is added in conventional amounts, for instance 100 to 2,000 g/tonne, based on solids content of the cellulosic suspension.

The ratio of starch:polymeric retention aid is often in the range 50:1 to 500:1 (based on dry weight).

When the process is conducted by draining the flocculated suspension, ie without subsequent shearing and reflocculation, this suspension may have been formed in conventional manner (apart from the addition of starch and cationic coagulant). For instance it may have been made from a groundwood, mechanical or thermomechanical pulp and the thin stock, or the thick stock from which it is formed, may have been treated with bentonite before the addition of the retention aid. In such processes, the retention aid is often substantially non-ionic, for instance being formed from 0 to 10 mole percent anionic and/or cationic monomers and 90 to 100 mole percent non-ionic monomers. However the invention, in this aspect, is not limited to the use of dirty pulps and includes the use of any suitable combination of pulp and high molecular weight retention aid (anionic, non-ionic or cationic) or dissolved cationic starch retention aid.

In these processes the retention aid and starch are usually added after the last point of high shear, e.g., immediately prior to the head box.

In the preferred processes of the invention, the flocculated suspension is subjected to shear so as to degrade the initial flocs and is then reflocculated, or subjected to supercoagulation, by the addition of anionic microparticulate material. The shearing can be achieved merely as a result of turbulent flow from the point at which retention aid is added to the point at which the microparticulate material is added, but often the shearing is applied by passage through a device such as a centriscreen, fan pump or other deliberate shear mixing stage. The shearing results in reduction of the size of the flocs, for instance as described in EP-A-235,893.

The starch particles can in this case be added with the anionic microparticulate material. As a result of intimate admixture of the starch particles and this material, the starch particles appear to become entrapped within the supercoagulation that occurs upon the addition of the microparticulate material and as a result good retention of the starch particles is obtained.

It is usually undesirable to add cationic coagulant as a component of the suspension of anionic microparticulate material. Therefore when the starch particles are added with the anionic microparticulate material the cationic coagulant is added at another point in the process.

Cationic coagulant may be added as a component of the aqueous solution of polymeric retention aid. It may be added before or after addition of the polymeric retention aid but always before addition of the microparticulate material to the cellulosic suspension. If added before the polymeric retention aid, it may be added to the thickstock or to the thinstock.

When the starch is being added with the microparticulate material, the slurry of starch and microparticulate material is usually free of any other significant solid phase and usually consists essentially only of water, the microparticulate material, the starch and any dispersing agent or other additives necessarily associated with the microparticulate material. The ratio dry weight of starch to microparticulate material is generally in the range 5:1 to 100:1, often around 10:1 to 50:1, by weight.

Typically the starch particles are injected into a slurry of the microparticulate material, or the microparticulate material is injected into a slurry of the starch particles, just before addition to the cellulosic suspension, although if desired the materials may be premixed and the resultant slurry pumped from the mixing station towards the addition point. The addition point is usually in the headbox or at some other position after the last point of substantial shear since it is usually desirable that the reflocculated or supercoagulated structure should not be degraded excessively by subsequent shear prior to drainage.

It is usually preferred to introduce the starch particles as a slurry in part or all of the aqueous solution of retention aid. If this is done it is preferred in certain aspects of the invention that the insoluble starch particles are present as substantially freely dispersed particles. Thus the amount of retention aid is generally considerably above the amount which might, under relatively static conditions, have a significant flocculating effect on the starch particles. If cationic coagulant is added, as is preferable, in the slurry of insoluble starch and retention aid the amount of cationic coagulant is also often chosen so as to minimise coagulation of the starch particles.

In practice the addition of the slurry of starch and polymer is normally accompanied by shear at the addition point and this will further promote the independent character of the particles. In view of the shearing that tends to occur during addition, and in view of the preferred shearing of the flocculated cellulosic suspension that follows the addition of the polymer and particles, some aggregation of the particles is acceptable.

It is important that the polymeric retention aid that is added is an effective retention aid for the cellulosic suspension in order that the polymer which is absorbed onto the starch particles will have adequate substantivity to the cellulosic fibres in the suspension. Selection of an appropriate retention aid that is substantive to the cellulosic suspension can be conducted in conventional manner. It can be anionic, non-ionic or cationic. However, the particular problem solved by this invention, that is interference of anionic material released by the cold water insoluble starch particles with the activity of the retention aid, is observed to a greater extent when the retention aid is cationic than when it is anionic or non-ionic. Further, best results are usually obtained when the retention aid is cationic. Therefore preferably the retention aid is cationic.

In the invention it is preferred to premix the starch slurry and cationic coagulant and then mix these with the solution of retention aid. It is possible however to mix the three simultaneously. It is also possible to premix the cationic coagulant and retention aid, usually in water, and subsequently mix these with the starch slurry, although this is less preferred.

Generally it is adequate to mix the starch (and often cationic coagulant) with the aqueous retention aid as the components flow towards the point at which the retention aid is added to the cellulosic suspension. For instance the starch/coagulant mix may be injected into the retention aid stream at some point between the polymeric retention aid make-up supply and the point where the solution is added to the cellulosic suspension. Often it is adequate to mix the starch/coagulant slurry into the solution just prior to the point at which the solution is added to the cellulosic suspension.

Frequently the starch is provided initially as a slurry of 10 to 40%, often around 20%, by weight starch in water and this slurry is mixed with the cationic coagulant and polymeric retention aid in the amounts required to give the chosen dosage of retention aid, cationic coagulant and starch.

Although the slurry that is added to the cellulosic thin-stock suspension can include other materials it is generally preferred and convenient for the slurry to consist substantially only of water, starch particles, polymeric retention aid and cationic coagulant, if used.

The cationic coagulant may be an inorganic coagulant, for instance alum or polyaluminium chloride or other known inorganic cationic coagulants.

Preferably however the coagulant is a polymeric coagulant.

The cationic polymeric coagulant has an intrinsic viscosity of 3 dl/g or below, often not more than 2 or 1 dl/g.

In this specification, intrinsic viscosity is measured at 25° C. in 1M sodium chloride buffered at pH7 using a suspended level viscometer.

The molecular weight of the cationic coagulant polymer is usually not more than 500,000, often 100,000 or less or even 50,000 or less.

The cationic charge density of the cationic coagulant is above 4 meq/g, preferably above 5 or 6 meq/g, most often around 7.5 meq/g.

In this specification, the theoretical cationic charge density is the charge density obtained by calculation from the monomeric composition which is intended to be used for forming the polymer.

The polymeric coagulant is preferably formed of recurring units of which at least 70 mol %, generally at least 90%, often 100%, are cationic.

Preferred cationic monomers include dialkylaminoalkyl (meth) acrylamide or acrylate quaternary salt or acid addition salt and diallyl dialkyl ammonium halides. Suitable polymers include homopolymers of diallyl dimethyl ammonium chloride and low molecular weight copolymers of this with a minor amount (usually below 30% and preferably below 10%) acrylamide; low molecular weight homopolymers of dialkylaminoalkyl (meth) acrylamide or acrylate quaternary salt or acid addition salt and copolymers of these with small amounts (generally below 30% and preferably below 10%) acrylamide; polyethylene imines; polyamines; epichlorhydrin diamine condensation products; dicyandiamide polymers; other conventional low molecular weight cationic coagulant polymers.

Mixtures of cationic polymers may be used, as may mixtures of cationic polymer and inorganic coagulant.

It is usually convenient and preferred for the starch to be added as a slurry with the entire retention aid that is to be used for flocculating the suspension, optionally prior to shearing and reflocculation, but if desired the slurry may be mixed with part only, for instance at least 5% and often at least 25% by weight, typically up to 50 or 75% by weight, of the total amount of retention aid. If retention aid is being added partly mixed with particulate starch and partly free of starch, different, high molecular weight, retention aids may be used for the two additions provided they are compatible, or the same material may be used for each addition.

If the cationic coagulant is being added in the solution of polymeric retention aid it may be added in one portion only or in all portions of retention aid.

The retention aid with which the particulate starch is mixed prior to addition to the cellulosic suspension can be soluble cationic starch and thus the system can consist of insoluble starch particles (usually chemically unmodified insoluble starch particles) slurried in a solution of cationic starch. However it is generally preferred that the retention aid is a synthetic polymer.

The preferred retention aids for use in the invention are polymers which have intrinsic viscosity above 4 dl/g and usually above 6 dl/g, for instance 8 to 15 dl/g or 8 to 20 dl/g or higher. Generally the retention aid has IV greater than that of the cationic coagulant, if it is polymeric. Generally also the retention aid has molecular weight greater than that of the cationic coagulant.

Non-ionic retention aids that can be used include polyacrylamide or other polymer of water soluble ethylenically unsaturated monomer or monomer blend, and polyethylene oxide.

Suitable anionic retention aids are polymers of anionic ethylenically unsaturated sulphonic or carboxylic monomer such as acrylic acid (usually as a sodium or other water soluble salt) optionally copolymerised with non-ionic ethylenically unsaturated monomer such as acrylamide. Thus the anionic polymer may be formed from, for instance, 3 to 50 mole percent, often 3 to 20 mole percent anionic monomer such as sodium acrylate with the balance being acrylamide.

Amphoteric polymers containing both anionic and cationic monomer units, usually with acrylamide or other non-ionic monomer, can be used.

Cross-linked polymeric retention aids may be used.

Cationic polymers are preferred.

The or each cationic high molecular weight polymer is usually a copolymer of ethylenically unsaturated cationic monomer, with the balance being other water soluble, generally non-ionic, ethylenically unsaturated monomer such as acrylamide. The amount of cationic monomer is usually at least 2 or 3 mole %. Generally it is not more than 20 mole % but it can be up to 50 mole % or more. The polymer can be wholly water soluble or it can be in the form of small particles of partially soluble cross-linked polymer as described in EP-A-202,780.

The or each high molecular weight cationic polymeric retention aid typically has a theoretical cationic charge density of less than that of the cationic coagulant, often not more than about 3 meq/g, in particular not more than about 2 meq/g. Generally it is at least about 0.1, or usually at least about 0.5, meq/g.

Suitable cationic monomers include dialkyl aminoalkyl (meth) -acrylates and -acrylamides as acid addition or quaternary salts. The alkyl groups may each contain 1–4 carbon atoms and the aminoalkyl group may contain 1–8 carbon atoms. Particularly preferred are dialkylaminoethyl (meth) acrylates or acrylamides and dialkylamino-1,3-propyl (meth) acrylamides.

Although it is usually preferred for the retention aid to have intrinsic viscosity above 8 dl/g, in some instances it can be desirable to use as the retention aid a copolymer of diallyl dimethyl ammonium chloride and acrylamide and which has intrinsic viscosity at least 4 dl/g, even though it may not be practicable to manufacture such a polymer to the IV 8 dl/g and higher values that are preferred for other polymers.

The total amount of polymeric retention aid is usually 0.01 to 1%, generally 0.02 to 0.1% (200 to 1,000 gram per tonne dry weight of suspension). When the process involves shearing and reflocculating with microparticulate material the amount of retention aid is generally in the range 0.01 to 0.06% or 0.1% but when the process is conducted merely with flocculation followed by drainage, i.e., without the shearing and reflocculation, the amount is usually in the range 0.04 to 0.15%, often 0.06 to 0.1%.

The amount depends, inter alia, on the choice of cellulosic thin stock. This may be formed from any convenient pulp or mixture of pulps. The thin stock typically has a cellulosic fibre content of 0.2 to 2.0%, usually 0.3 to 1.5% by weight.

The retention aid of IV above 4 dl/g (or cationic starch) and the amount of it which is used in the process must be such as to give good retention of fibre fines and filler (if present). Selection of the retention aid and its amount can be conducted in conventional manner by performing the process in the absence of starch with different amounts of different retention aids so as to select an effective combination of retention aid and its amount for the particular cellulosic suspension that is being treated. Naturally this test should be conducted with the subsequent addition of microparticulate anionic material when the overall process involves the use of that material. When the initial cellulosic suspension includes anionic trash, it can be desirable to treat the suspension initially with a cationic coagulant and/or bentonite so as to reduce the amount of polymeric retention aid that is required, in addition to the inclusion of cationic coagulant required by the invention.

According to the invention we can include in the cellulosic suspension high charge density cationic coagulant which interacts with anionic material released by the insoluble starch particles and prevents them interacting with the retention aid and hindering its retention performance. We believe that even where the cationic coagulant and retention aid are mixed with the starch simultaneously the cationic coagulant interacts preferentially with the anionic charge released by the starch due to its very high charge density.

Preferably the cationic coagulant also interacts with any other anionic soluble material in the cellulosic suspension. In the invention the total amount of retention aid used should be at or above the amount which is the stoichiometric amount required to react with any remaining anionic materials in the cellulosic suspension and any pulp from which it is formed. Generally the suspension is made without deliberate addition of anionic polymeric materials.

By saying that the cellulosic suspension is flocculated we mean that it has the state which is typical of a cellulosic suspension which has been treated with an effective high molecular weight retention aid in an effective amount.

In preferred processes, the retention system is selected and optimised (using high IV polymer or dissolved cationic starch) for retention, drainage and drying properties in conventional manner, and the particulate starch (and cationic coagulant if used) are injected into the polymer solution with no substantial change in the optimum retention system.

The starch in the particles remains substantially undissolved prior to the start of drainage of the suspension, even though it tends to release anionic charge into the slurry of starch. Preferably the amount of dissolved starch in the drainage water should represent less than 20%, preferably less than 10% and most preferably less than 5% of the amount of particulate starch in the suspension after discounting soluble starch originating elsewhere.

One way of providing that the particles remain substantially undissolved prior to drainage is to introduce the starch in ungelatinised, substantially water-insoluble, form and to maintain the conditions in the suspension such that significant gelatinisation does not occur prior to the start of drainage. In such a process, it is necessary to gelatinise the starch during the draining and drying stages.

In conventional processes, draining is completed at temperatures above ambient, and drying is conducted with the application of heat. By appropriate choice of the draining and drying conditions and of the grade of ungelatinised starch, it is possible to achieve appropriate gelatinisation during the drying stage, while the sheet is still moist. It can be desirable to apply deliberate heating to the wet sheet, even before final drainage is completed, so as to pre-warm it before entry to the drying stages. For instance the wet sheet may be passed under a steam hood or heater such as a Devroniser (trade mark), and this can facilitate full gelatinisation and dissolution of the starch.

The act of shearing the flocculated suspension prior to reflocculation will necessarily tend to break up any flocs or aggregates of starch particles, and so this preferred process will tend to result in the starch particles being more uniformly distributed as mono- particles through the sheet. As a result, more thorough gelatinisation of these particles will occur than when clusters of particles are present in the sheet, and this is an important advantage of the preferred processes of the invention which involve shearing and reflocculation of the flocculated suspension.

The starch particles need to gelatinise while there is still some moisture in the sheet in order to allow gelatinisation to proceed satisfactorily and in order to allow the particles to spread in the sheet so as to tend to provide a film within the sheet, in contrast to mere spot bonds. However, the existence of spot bonds can still have a positive effect on the paper strength. As a result of the starch gelatinising in the presence of moisture, it will tend to migrate between the fibres so as to obtain more uniform distribution of the starch on and around and between the paper fibres. The amount of moisture that should remain in the sheet when the starch is dissolving can be quite low, and only needs to be sufficient to allow migration of the gelatinised starch sufficient to give adequate distribution of the starch through the sheet.

To facilitate attainment of rapid gelatinisation, it may be desirable to use a starch that has naturally a low temperature gelatinisation or that has been modified to reduce its temperature of gelatinisation, provided it remains substantially undissolved prior to drainage. We find that the greater the degree of modification of a starch the greater the cationic demand it produces and the greater required level of cationic coagulant.

Usually the starch is an uncooked, raw starch such as raw maize, potato, corn, wheat or tapioca starch.

Pregelatinised or precooked (and therefore soluble) starch can be included as insoluble particles. Thus, instead of relying on the insolubility of ungelatinised starch particles and the subsequent cooking occurring during the process, the dissolution of precooked starch in the particles of the suspension can be prevented by protecting the starch with a water impermeable shell or matrix that disintegrates during the subsequent draining or drying. Any material which provides sufficient water impermeability to prevent significant dissolution of the starch prior to draining can be used provided the shell or matrix will disintegrate to release the starch during draining and/or drying.

The shell or matrix does not have to provide long term water-impermeability. For instance a slow dissolving shell or matrix may be sufficient to protect the starch since even if the shell disintegrates partially within the headbox there may still be inadequate time for the enclosed starch particle to dissolve in the headbox.

The shell or matrix may be a thermoplastic material having a melting point such as to prevent premature disintegration of the shell or matrix. For instance the normal temperature of the suspension leading to the headbox is typically in the range 40°–50° C. and the ambient temperature around the drainage screen is typically in the same range. If the particles are provided with a coating or matrix which has a melting temperature at about or above the temperature of the headbox, substantially no melting will occur until the headbox and most of the melting and substantially all the dissolution of the starch will not occur until most of the draining has been completed. Suitable thermoplastic materials that can be used include hydrocarbon waxes.

Instead of using a thermoplastic shell or matrix, a pH sensitive shell or matrix may be used. For instance the cooked starch may be encapsulated or otherwise protected by polymer that is water insoluble and non-swellable at the pH of the starch dispersion which is provided to the mill, and this dispersion is added to the headbox which is at a pH at which the polymer swells or dissolves. For instance the protective polymer can be a copolymer of water soluble and water insoluble ethylenically unsaturated monomers such as methacrylic acid or other water soluble monomer and ethyl acrylate or other water insoluble monomer. The manufacture of pH sensitive polymers of this general type by oil-in-water emulsion polymerisation is well known.

Methods of incorporating an active ingredient within particles of a protective matrix or within a shell are well known and can be used in the invention. For instance the mixture of the starch and protective material may be spray dried or a coacervate coating may be formed around starch particles.

The amount of starch that is included in the sheet will normally be at least 0.05% and usually at least 0.2% dry weight. The greatest advantages of the process are achieved when the amount is above 2 or 3%, for instance 5%, 10% or even up to 12 or 15% by weight. However an advantage of the process of the invention is that the process can be operated either at high starch loadings or low starch loadings merely by altering the amount of starch, without making any significant changes in the remainder of the process.

The size of the particles is generally at least 90% by weight below 100 μm, preferably below 50 μm, often 5 to 50 μm. The starch particles may have a size of at least 90% by weight up to 10 μm, generally 5–10 μm. The starch is preferably granular, so that all three dimensions may be broadly similar.

The anionic microparticulate or colloidal material (when used) is preferably bentonite, that is to say an inorganic swelling clay, for instance as described in EP-A-235,893. However it can be colloidal silica (such as described in U.S. Pat. No. 4,643,801), polysilicate microgel (such as described in EP-A-359,552), polysilicic acid microgel as described in EP-A-348,366, or aluminum modified versions of any of these. Instead of using inorganic anionic colloidal material, organic material can be used. Thus it is possible to use an anionic organic polymeric emulsion. The emulsified polymer particles may be insoluble due to being formed of a copolymer of, for instance, a water soluble anionic polymer and one or more insoluble monomers such as ethyl acrylate, but preferably the polymeric emulsion is a crosslinked microemulsion of water soluble monomeric material. The particle size of the colloidal material is generally below 2 μm, preferably below 1 μm and most preferably below 0.1 μm.

The amount of colloidal material (dry weight based on the dry weight of the cellulosic suspension) is generally 5 at least 0.03% and usually at least 0.1%. It can be up to, for instance 2% but is generally below 1%. The choice and the amount of the anionic colloidal material should be such as to cause what is frequently referred to as "super coagulation".

The anionic microparticulate or colloidal material is preferably added to the suspension after the last point of high shear, for instance at the headbox, and the suspension can then be drained in conventional manner.

Initial selection of suitable materials can be made on the basis of trials with conventional laboratory apparatus such as a Britt jar and a hand sheet technique, but commercial operation of all the processes of the invention is conducted on a paper-making machine wherein the cellulosic thin stock is provided in conventional manner, generally by dilution of thick stock with white water, and is fed towards a headbox through suitable apparatus such as a fan pump and centriscreen, and is discharged from the headbox onto a moving screen.

This screen may travel at conventional screen speeds which are normally in excess of 100 meters per minute and typically are in the range 700 to 1500 meters per minute.

The machine will include a drying zone in conventional manner but an advantage of the invention is that it is not necessary for the machine to be equipped with a size press or with any other means of applying starch to the wet sheet or to the dried sheet.

If desired, however, further starch can be applied to the wet sheet or the dried sheet in conventional manner.

We find that the process of the invention is particularly effective when the white water drained from the stock is recycled into the process, for instance to dilute the thick-stock. We believe this is due to drainage of soluble anionic materials released from the insoluble starch into the white water and subsequent build-up if the white water is recycled, which can lead to reduced efficiency of retention aid of the process of the invention is not used. Thus preferably the process of the invention is carried out on a papermaking machine in which the white water is recycled into the process at least once. More preferably the papermaking system is an essentially closed system, that is one in which essentially no white water is released into the environment, but is all recirculated into the process.

EXAMPLES

The following are examples of the invention.

Example 1

Paper was made on a Fourdrinier machine to a grade of 400 g/m$^2$. As a retention aid an aqueous solution of a copolymer of acrylamide and 10 mol % dimethylaminoethyl acrylate quaternary salt (DMAEAqMeCl), having IV 12 dl/g was used. Unmodified raw potato starch as a 20% slurry was premixed with the cationic coagulant which was a polyamine of IV 0.4 dl/g and charge density 7.5 meq/g. This mixture was injected into the retention aid line just before its addition to the thinstock before the centriscreen. Bentonite was added after the centriscreen. Amounts of each material added are shown below in Table 1. Results are shown in Table 2.

Run number 1 did not involve the addition of any starch. Run numbers 2 to 6 did not involve the addition of any cationic coagulant. Run numbers 7 to 9 are processes involving the addition of starch and cationic coagulant.

TABLE 1

| Run No. | Retention Aid (g/tonne solids content of the cellulosic suspension | Coagulant (g/tonne solids content of the cellulosic suspension) | Bentonite (kg/tonne solids content of the cellulosic suspension) |
|---|---|---|---|
| 1 | 599 | 0 | 3.33 |
| 2 | 758 | 0 | 3.24 |
| 3 | 747 | 0 | 3.19 |
| 4 | 730 | 0 | 3.12 |
| 5 | 696 | 0 | 2.98 |
| 6 | 696 | 0 | 2.98 |
| 7 | 696 | 1333 | 2.98 |
| 8 | 687 | 1315 | 2.93 |
| 9 | 687 | 2700 | 2.93 |

TABLE 2

| Run No. | Starch level in paper % | Retention % | Plybond Strength (kJ/m$^2$) | Stiffness | Tensile (N/m) |
|---|---|---|---|---|---|
| 1 | 0 | 95.79 | 96 | 848 | 223 |
| 2 | 3.2 | 95.79 | 121 | 799 | 227 |
| 3 | 3.2 | 96.00 | 149 | 636 | 239 |
| 4 | 3.1 | 95.05 | 131 | 740 | 317 |
| 5 | 3.0 | 95.45 | 140 | 690 | 281 |
| 6 | 3.0 | 95.45 | 142 | 700 | 258 |
| 7 | 3.0 | 95.83 | 142 | 700 | 258 |
| 8 | 3.6 | 95.83 | 151 | 561 | 298 |
| 9 | 3.6 | 95.87 | 151 | 561 | 298 |

From these results it can be seen that the inclusion of the cationic coagulant allows the introduction of larger amounts of starch and achievement of higher retention values and plybond strength without the necessity for increasing the level of retention aid components. In fact the levels of these components can even be reduced.

Paper was also made at 200 gsm using the same retention system and cationic coagulant. Again good retention values were seen, as shown in Table 3 below.

TABLE 3

| Run No. | Retention Aid (g/tonne solids content of cellulosic suspension) | Coagulant (g/tonne solids content of cellulosic suspension) | Bentonite (kg/tonne solids content of cellulosic suspension) | Starch Level in paper % | Retention % |
|---|---|---|---|---|---|
| 10 | 341 | 2327 | 2.22 | 3.1 | 90.91 |
| 11 | 341 | 2528 | 2.22 | 3.1 | 90.91 |
| 12 | 73 | 2153 | 2.49 | 2.9 | 87.27 |
| 13 | 373 | 2070 | 2.39 | 2.8 | 88.29 |
| 14 | 376 | 2786 | 2.41 | 3.6 | 90.00 |
| 15 | 389 | 2731 | 2.38 | 3.6 | 90.91 |

Example 2

This example is a laboratory simulation of the improvement in retention which can be achieved in a system using retention aid polymer and bentonite with starch added together with the retention aid, by including with the retention aid and starch a cationic coagulant polymer.

The furnish used was produced from 60% newsprint, 30% cardboard and 10% magazine. It was disintegrated for 2,000 revolutions and left to condition overnight for test work the following day.

Consistency tests were carried out by passing a weighed amount of stock (or white water) through a pre-weighed filter paper, drying at 110° C., conditioning for half an hour and reweighing. The test was repeated in triplicate. The final dry weight of the stock was then established.

Stock consistency is calculated as follows: stock consistency =[(final dry weight/initial stock weight)]×100.

The starch slurry was a slurry of 20% enzyme treated wheat starch in deionised water. The retention aid is a copolymer of 10 mol % DMAEqMeCl with acrylamide having IV 9 dl/g.

The cationic coagulant is a polyamine having IV 0.4 dl/g and charge density 7.5 meq/g.

The starch/retention aid mixture was made by adding to the 20% starch slurry the appropriate amount of 0.5% retention aid solution and mixing thoroughly. The starch/retention aid/coagulant mixture was made by mixing 1% coagulant solution and 20% starch slurry thoroughly in the appropriate amounts. 0.5% solution of retention aid was added and the mixture stirred thoroughly again.

1,000 ml of 1% stock was produced using tap water. The stock was stirred for 5 seconds in a blocked baffled Britt jar at 1,500 rpm. An addition was then made of either retention aid alone, starch/retention aid or starch/retention aid/coagulant. The stock was then stirred further for 30 seconds at 1,500 rpm. Stirrer speed was then reduced to 800 rpm and bentonite added at a concentration of 2 kg/tonne. The stock was stirred further for 5 seconds. The Britt jar tap was then opened and the first 5 seconds of white water discarded, the following 30 seconds ("30 seconds white water") collected separately and the remainder ("remaining white water") collected for later use.

Further tests were carried out using 500 ml of the "remaining white water" and tap water to produce the 1,000 ml of 1% stock, to simulate recycling conditions.

The consistency of the "30 seconds white water" was calculated and retention values calculated from this.

Retention=[(stock consistency—white water consistency)/stock consistency]×100.

Further tests were conducted on the recycling simulation to show performance after recirculation.

Results are shown below in Table 4.

When the amount of particulate starch in the suspension was increased to 3.11%, the amount in the sheet was raised to 4.34%, and when the amount in the suspension was raised to 3.50%, the amount in the sheet was raised to 4.55%, again indicating substantially complete retention.

TABLE 4

| | Retention Aid & Bentonite | | Retention Aid/ Starch & Bentonite | | Retention Aid/Starch/ Coagulant & Bentonite | |
|---|---|---|---|---|---|---|
| Run No. | Retention (%) | Decrease in performance on recirculation (Retention %) | Retention (%) | Decrease in performance on recirculation (Retention %) | Retention (%) | Decrease in performance on recirculation (Retention %) |
| 1 | 91.92 | 0 | 89.49 | 0 | 88.12 | 0 |
| 2 | 87.57 | 4.35 | 85.08 | 4.41 | 87.52 | 0.63 |
| 3 | 89.55 | 2.37 | 83.05 | 6.44 | 87.14 | 1.01 |
| 4 | 88.68 | 3.24 | 83.27 | 6.22 | 85.69 | 2.47 |
| 5 | 94.14 | 2.22 | 83.21 | 6.28 | 85.90 | 2.25 |
| 6 | 89.06 | 2.86 | 86.15 | 3.34 | 85.86 | 2.29 |
| 7 | 87.26 | 4.66 | 85.68 | 3.81 | 85.36 | 2.79 |
| 8 | 86.99 | 4.96 | 82.27 | 7.22 | 87.50 | 0.65 |
| 9 | 87.30 | 4.62 | 81.47 | 8.02 | 89.71 | −1.56 |
| 10 | 86.52 | 5.40 | 84.75 | 4.74 | 85.32 | 2.83 |
| 11 | | | 83.40 | 6.09 | | |

These results show the improvements obtained in the invention when white water is recycled in comparison with the conventional Hydrocol system (retention aid+bentonite) and even in comparison with the retention aid/starch+bentonite system.

Example 3

A mill trial was carried out on a Fourdrinier machine producing fluting medium at 600 m/min from 100% waste furnish. A cationic polymer of acrylamide with 10% mole cationic acrylate, IV 12 dl/g, was added to the thin stock before the centriscreen at a dose level of 800 g/tonne. A 20% slurry of raw starch was added to the polymer line just prior to the addition of the polymer to the thin stock, in sufficient quantities to provide 5% starch on dry weight of paper. Bentonite was added to the thin stock after the centriscreen and just before the head box, at a dose level of 0.5%.

Analysis of starch retained in the sheet showed that over 95% of the added starch was retained in the sheet. The heating during the drying stages of the machine caused the starch to be gelatinised during the drying.

Example 4

Liner board having a weight of about 140 grams per square meter was made on a Fourdrinier machine in a process using as retention aid an aqueous solution of a polymer of acrylamide with 10 mol % dimethylaminoethyl acrylate quaternary salt [DMAEAq], having IV 12 dl/g, at a dosage of 850 g/tonne in the top ply and 790 g/tonne in the bottom ply, added before the centriscreen and bentonite at a dosage of 5 kg/t in both the top and bottom ply added after the centriscreen. The suspension included recycled paper and it was found that the starch content in the sheet, with no deliberate addition of starch, fluctuated between about 0.9 and 1.2%.

Particulate raw potato starch was then injected as a slurry into the polymer feed line at a dosage of 1.42% based on the dry weight of the suspension. When steady state conditions had been re-established, the amount of starch in the sheet was 2.49%, indicating substantially complete retention of the particulate starch.

The burst strength was increased by about 35% and the CMT value by about 20%.

Example 5

In order to conduct preliminary screening of suitable combinations of materials, a waste furnish was prepared from 60% newsprint, 30% cardboard and 10% magazine and was pulped in a laboratory disintegrator for 20 minutes and then diluted to form a 0.5% thin stock suspension at 25° C. It was left to condition for 24 hours. It had pH 7.5 to 7.7.

500 mls of thin stock was placed in a Britt Dynamic Drainage jar fitted with a machine wire with the stirrer set at 1500 rpm. The required amount of a 20% starch slurry was mixed with the required amount of a 0.5% solution of polymer and added to the drainage jar. After stirring for 60 seconds at 1500 rpm the stirrer was slowed to 800 rpm and the required amount of bentonite slurry was added. After 10 seconds mixing, the backwater was collected for 30 seconds.

The collected backwater was cooked at 100° C. for 30 minutes, the volume re-adjusted to the original volume and the sample centrifuged to remove fibres. Acidified potassium iodide/iodine reagent was added and the blue starch/iodine complex was assessed optically and compared to a calibration graph to give an indication of the starch content of the water. Due to the particular analytical techniques used the values are more indicative of relative values than absolute values, but increasing the value indicates increased retention.

In a first series of tests, polymer (acrylamide with 10 mol % dimethylaminoethyl acrylate quaternary salt, IV 12 dl/g) was added at 750 grams per tonne fibre, bentonite at 2,000 grams per tonne fibre and starch 80 kg per ton fibre (8%). The following results were obtained.

| Addition Point | Starch Retention |
|---|---|
| Starch No Polymer No Bentonite | 74 |
| Starch before Polymer | 81.4 |

-continued

| Addition Point | Starch Retention |
|---|---|
| Starch with Polymer | 96.5 |
| Starch after Polymer | 82.6 |
| Starch with Bentonite | 93.1 |

These results indicate that best results are obtained when starch is mixed with the polymer (followed by the bentonite). Useful retention is also obtained when the polymer is added separately and the starch is subsequently added with the bentonite. Addition of the starch by itself, before or after the polymer, gives poor results.

Example 6

A process broadly as in Example 5 was repeated comparing the retention (measured as in Example 3) at 4%, 6% and 8% starch when there is no polymer and bentonite (control) or when the starch is added with 750 g/t polymer followed by 2,000 g/t bentonite.

| Starch Addition | Retention System | Starch Retention |
|---|---|---|
| 4% | No | 57.9 |
| 4% | Yes | 99.4 |
| 6% | No | 63.1 |
| 6% | Yes | 83.7 |
| 8% | No | 71.2 |
| 8% | Yes | 90.5 |

The amount of starch added based on the volume of the suspension at the 4%, 6% and 8% amounts based on the weight of fibre was 200, 300 and 400 ppm respectively.

Example 7

A process broadly as described in Example 5 was used except that in the three tests conducted using polymer in the absence of anionic microparticulate material the starch was added with the polymer solution to the drainage jar with the stirrer set at 800 rpm and after 10 seconds mixing the backwater was collected for 30 seconds. Starch retention was measured as in Example 3.

The results were as follows:

| Product | Dosage | Starch Retention |
|---|---|---|
| Polyethylene imine | 1,000 g/t | 72.6 |
| Polyamine epichlorhydrin | 1,000 g/t | 78.3 |
| 10 mol % DMAEAq/90 mol % acrylamide copolymer IV 12 | 750 g/t | 92.5 |
| 10 mol % DMAEAq/90 mol % acrylamide IV 12 followed by polysilicic acid | 750 g/t plus 500 g/t | 91.7 |

These results clearly demonstrate the greatly improved retention that is attainable using high IV cationic polymer compared to low molecular weight cationic polymers. They also show that good results can be obtained using polysilicic acid as the anionic microparticulate material but direct comparison between the two tests with the cationic polyacrylamide is not wholly reliable because of the different conditions used for the tests.

I claim:

1. A process for making paper on a paper-making machine comprising providing a cellulosic thin stock suspension, flocculating the suspension by adding an aqueous solution of polymeric retention aid selected from cationic starch and synthetic anionic, nonionic or cationic polymeric materials having IV above 4 dl/g and thereby forming a flocculated suspension, shearing the flocculated suspension and reflocculating the sheared suspension by adding an aqueous suspension of micro- particulate anionic material selected from inorganic swelling clays, microemulsions of cross linked polymer of water-soluble monomeric material, colloidal silica, polysilicate microgels, polysilicic acid microgels and aluminum modified colloidal silica, aluminum modified polysilicate microgel and aluminum modified polysilicic acid microgel and thereby forming a reflocculated suspension, draining the flocculated or reflocculated suspension through a moving screen to form a wet sheet, and carrying the sheet through a heated drying zone and thereby forming a dry sheet, wherein insoluble particles of starch are added to the cellulosic suspension in an amount of 1.5–10% by weight based on the solids content of the cellulosic suspension, as a slurry of substantially freely dispersed particles in part or all of the aqueous suspension of micro-particulate anionic material and at least 80% by weight of the particles are retained in the sheet, and the insoluble particles of starch are heated during the drying and release soluble starch into the sheet in the presence of moisture.

2. A process according to claim 1 in which the paper is a filled paper.

3. A process according to claim 1 in which the paper is substantially unfilled paper.

4. A process according to claim 1 in which the starch in the particles is ungelatinised such that substantially no dissolution of starch into the suspension occurs prior to drainage, and the starch is gelatinised during the draining and/or drying.

5. A process according to claim 1 in which the retention aid is a synthetic polymeric material having intrinsic viscosity at least 8 dl/g.

6. A process according to claim 1 in which the polymeric retention aid is cationic.

7. A process according to claim 1 in which the sheet contains 20 to 60% by weight filler.

8. A process according to claim 1 in which the sheet is a substantially unfilled sheet which is fluting medium or liner board.

9. A process according to claim 1 in which the amount of starch in the sheet is from 2 to 10%.

* * * * *